US012186620B1

(12) United States Patent
Lawrence

(10) Patent No.: US 12,186,620 B1
(45) Date of Patent: Jan. 7, 2025

(54) FITNESS APPARATUS

(71) Applicant: Stephen Thomas Lawrence, Westerville, OH (US)

(72) Inventor: Stephen Thomas Lawrence, Westerville, OH (US)

( * ) Notice: Subject to any disclaimer, the term of this patent is extended or adjusted under 35 U.S.C. 154(b) by 104 days.

(21) Appl. No.: 17/481,112

(22) Filed: Sep. 21, 2021

Related U.S. Application Data

(60) Provisional application No. 63/081,859, filed on Sep. 22, 2020.

(51) Int. Cl.

| | |
|---|---|
| ***A63B 22/00*** | (2006.01) |
| ***A63B 21/00*** | (2006.01) |
| ***A63B 21/005*** | (2006.01) |
| ***A63B 22/02*** | (2006.01) |
| ***A63B 24/00*** | (2006.01) |
| ***A63B 71/06*** | (2006.01) |

(52) U.S. Cl.
CPC ..... *A63B 22/0012* (2013.01); *A63B 21/0058* (2013.01); *A63B 21/151* (2013.01); *A63B 21/4035* (2015.10); *A63B 22/025* (2015.10); *A63B 24/0087* (2013.01); *A63B 71/0622* (2013.01); *A63B 2071/0647* (2013.01); *A63B 2071/0683* (2013.01); *A63B 2225/20* (2013.01)

(58) Field of Classification Search
CPC ..... A63B 22/0012; A63B 21/4035; A63B 22/025; A63B 21/0058; A63B 21/151; A63B 24/0087; A63B 71/0622; A63B 2071/0647; A63B 2071/0683; A63B 2225/20
See application file for complete search history.

(56) References Cited

U.S. PATENT DOCUMENTS

| | | | | |
|---|---|---|---|---|
| 8,075,453 | B1 * | 12/2011 | Wilkinson | A63B 21/4019 482/8 |
| 9,968,816 | B2 | 5/2018 | Olson et al. | |
| 10,486,015 | B2 | 11/2019 | Valente et al. | |
| 10,500,441 | B2 | 12/2019 | Lagree | |
| 2011/0281691 | A1 * | 11/2011 | Ellis | A63B 23/047 482/54 |
| 2015/0335951 | A1 * | 11/2015 | Eder | G16H 40/67 482/8 |
| 2016/0287929 | A1 * | 10/2016 | Poole | A63B 21/0552 |

FOREIGN PATENT DOCUMENTS

| | | | | |
|---|---|---|---|---|
| WO | WO-2007064318 | A1 * | 6/2007 | A63B 21/0618 |

* cited by examiner

*Primary Examiner* — Sundhara M Ganesan
*Assistant Examiner* — Jacqueline N L Loberiza
(74) *Attorney, Agent, or Firm* — The Law Office of Patrick F. O'Reilly III, LLC

(57) ABSTRACT

A fitness apparatus is disclosed herein. The fitness apparatus includes a treadmill, the treadmill having one or more displaceable treadmill elements that are configured to receive a user thereon; and at least one resistance assembly coupled to the treadmill, the at least one resistance assembly configured to create a resistance load for the user so that the user is able to perform strength exercises while simultaneously performing cardiovascular exercises on the treadmill.

17 Claims, 9 Drawing Sheets

FITNESS APPARATUS

CROSS-REFERENCE TO RELATED APPLICATIONS

This patent application claims priority to, and incorporates by reference in its entirety, U.S. Provisional Patent Application No. 63/081,859, entitled "Fitness Apparatus", filed on Sep. 22, 2020.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a fitness apparatus. More particularly, the invention relates to a fitness apparatus that enables a user to perform strength exercises while simultaneously performing cardiovascular exercises.

2. Background

Time is the number one reason why people don't exercise. Exercise in the past has been broken down into two categories, namely aerobic and anaerobic. Both requiring separate time commitments, and both have their unique benefits. By systematically combining both forms into a structured workout allows for an efficient workout with all health benefits from exercise in a shorter time period.

Proprioception is the body's ability to receive input through receptors in the skin, muscles and joints, and transfer the information to the brain through the nervous system so that the body can sense itself. Proprioception tells the body where it is in space. Proprioception is very important to the brain as it plays a big role in self-regulation, coordination, posture, and body awareness. It relies on sensory organs called proprioceptors located within muscles, tendons and joints that enable the sensation of tension, force, pressure and movement. Proprioception enables us to judge limb movements and positions, limb velocity, load on a limb, and limb limits. Proprioception is the key sense involved in learning new movement patterns.

NME (Neuromuscular Efficiency) is the ability of the nervous system to recruit the correct muscles (i.e., agonists, antagonists, synergists, and stabilizers) to produce force (concentrically), reduce force (eccentrically), and dynamically stabilize (isometrically) the entire kinetic chain in all three planes of motion.

Time Under Tension refers to how much time the muscles are under stress. Muscles under stress for longer periods of time will be stressed closer to total fatigue, which in turn, creates greater muscle fiber recruitment. The motor units in the muscle being worked are recruited from smallest to largest. The more time you keep a muscle under tension, the greater chance you have of recruiting fast twitch muscle fibers (Henneman's size principle). The more time under tension, the greater the growth hormone release will be. The body does more work, therefore the body will expend more calories.

Therefore, what is needed is a fitness apparatus that enables a user to perform strength exercises, while simultaneously performing cardiovascular exercises. Moreover, a fitness apparatus is needed that enhances the neuromuscular efficiency (NME) of a user without requiring multiple pieces of training equipment. Furthermore, there is a need for a fitness apparatus that allows for strength training exercises to be performed in multi-planar movements through the full or nearly full muscle action spectrum in motion.

BRIEF SUMMARY OF EMBODIMENTS OF THE INVENTION

Accordingly, the present invention is directed to a fitness apparatus that substantially obviates one or more problems resulting from the limitations and deficiencies of the related art.

In accordance with one or more embodiments of the present invention, there is provided a fitness apparatus that includes a treadmill, the treadmill having one or more displaceable treadmill elements that are configured to receive a user thereon; and at least one resistance assembly coupled to the treadmill, the at least one resistance assembly configured to create a resistance load for the user so that the user is able to perform strength exercises while simultaneously performing cardiovascular exercises on the treadmill.

In a further embodiment of the present invention, the one or more displaceable treadmill elements comprise a treadmill belt configured to rotate about a pair of spaced-apart rollers.

In yet a further embodiment, the treadmill further comprises one or more first actuator elements that are capable of adjusting a speed of the treadmill belt.

In still a further embodiment, the treadmill further comprises a first control device operatively coupled to the one or more first actuator elements, the first control device enabling the user to selectively adjust the speed of the treadmill belt.

In yet a further embodiment, the treadmill further comprises one or more second actuator elements that are capable of adjusting the inclination and declination of the treadmill.

In still a further embodiment, the treadmill further comprises a second control device operatively coupled to the one or more second actuator elements, the second control device enabling the user to selectively adjust the inclination and declination of the treadmill.

In yet a further embodiment, the at least one resistance assembly comprises a plurality of resistance assemblies disposed around an outer periphery of the treadmill.

In still a further embodiment, at least a first one of the plurality of resistance assemblies is disposed proximate to a front of the treadmill, at least a second one of the plurality of resistance assemblies is disposed on a side of the treadmill, and at least a third one of the plurality of resistance assemblies is disposed proximate to a rear of the treadmill.

In yet a further embodiment, the plurality of resistance assemblies are coupled to the treadmill by a base assembly disposed underneath the treadmill.

In still a further embodiment, the at least one resistance assembly comprises a resistance cable attached to a handle at one end of the resistance cable.

In yet a further embodiment, the handle of the at least one resistance assembly comprises a hand control device for enabling the user to selectively adjust the resistance load of the at least one resistance assembly.

In still a further embodiment, the at least one resistance assembly comprises a tension generating device coupled to the resistance cable.

In yet a further embodiment, the tension generating device of the at least one resistance assembly comprises at least one of an electrical resistance device, one or more pneumatic devices, one or more hydraulic devices, one or more springs, one or more weights, one or more flexing nylon rods, one or more elastics, and one or more friction-based devices.

In still a further embodiment, the tension generating device of the at least one resistance assembly comprises at least one electrical resistance device operatively coupled to a data processing device, the data processing device configured to control the resistance load of the at least one resistance assembly by regulating an amount of tension generated by the tension generating device.

In yet a further embodiment, the fitness apparatus further comprises a visual display device coupled to the treadmill, the visual display device configured to display screen images to the user that provide the user a visual guide on proper form and exercise progression together with workout performance parameters.

In still a further embodiment, the fitness apparatus further comprises a data processing device operatively coupled to the treadmill, the data processing device operatively coupled to a remote computing device so as to enable a sharing of user performance data with an individual located remotely.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

A first illustrative embodiment of a fitness apparatus is shown in FIGS. 1-4 and 8. With initial reference to FIG. 3, it can be seen that the fitness apparatus generally comprises a treadmill 8, the treadmill 8 having one or more displaceable treadmill elements that are configured to receive a user thereon; and a plurality of resistance assemblies 2A, 2B, 3A, 3B, 6A, 6B, 7A, 7B coupled to the treadmill 8, the plurality of resistance assemblies 2A, 2B, 3A, 3B, 6A, 6B, 7A, 7B configured to create a resistance load for the user so that the user is able to perform strength exercises while simultaneously performing cardiovascular exercises on the treadmill 8.

Figure 1:
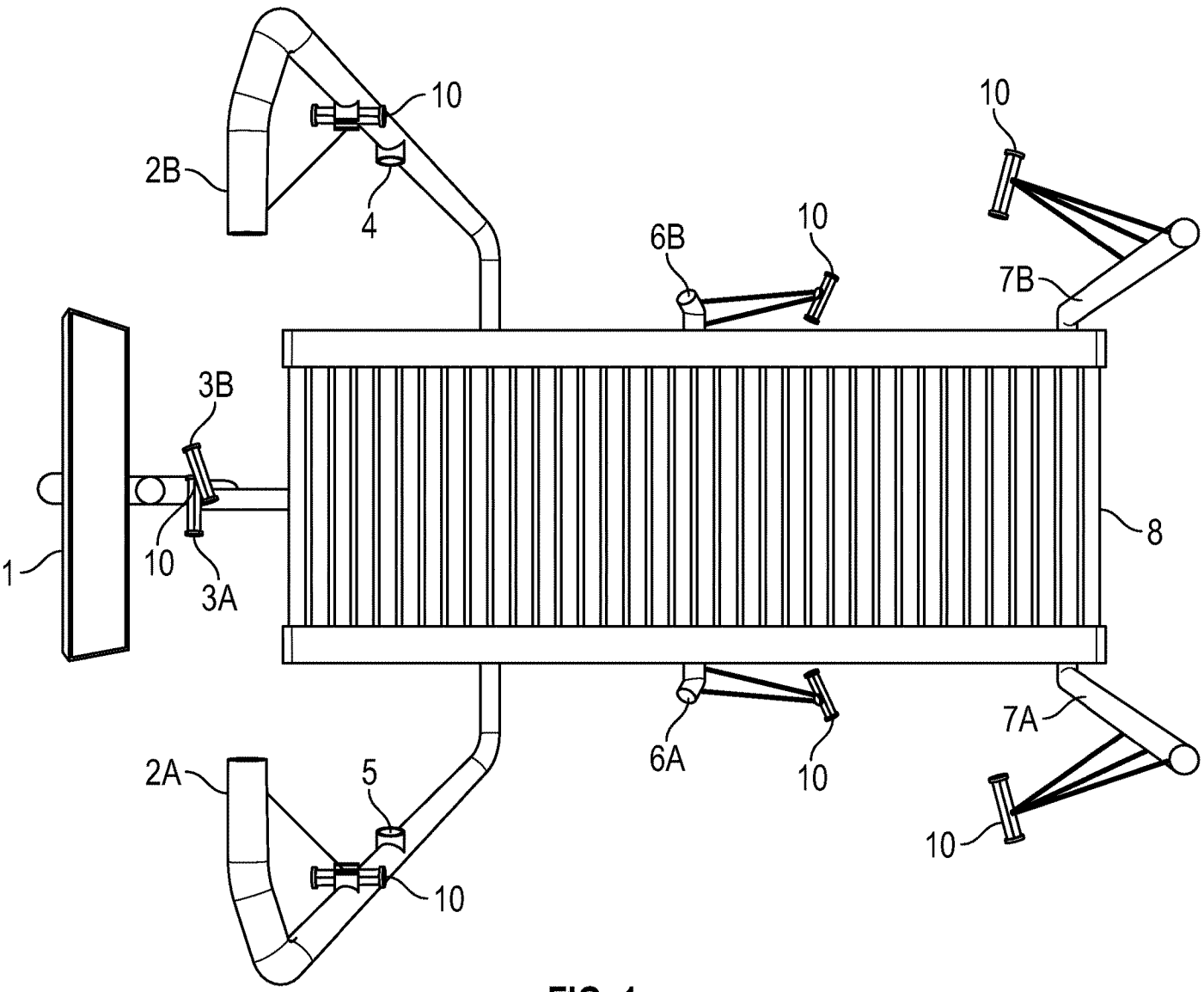
FIG. 1 is top perspective view of a fitness apparatus, according to one embodiment of the invention.
Figure 3:
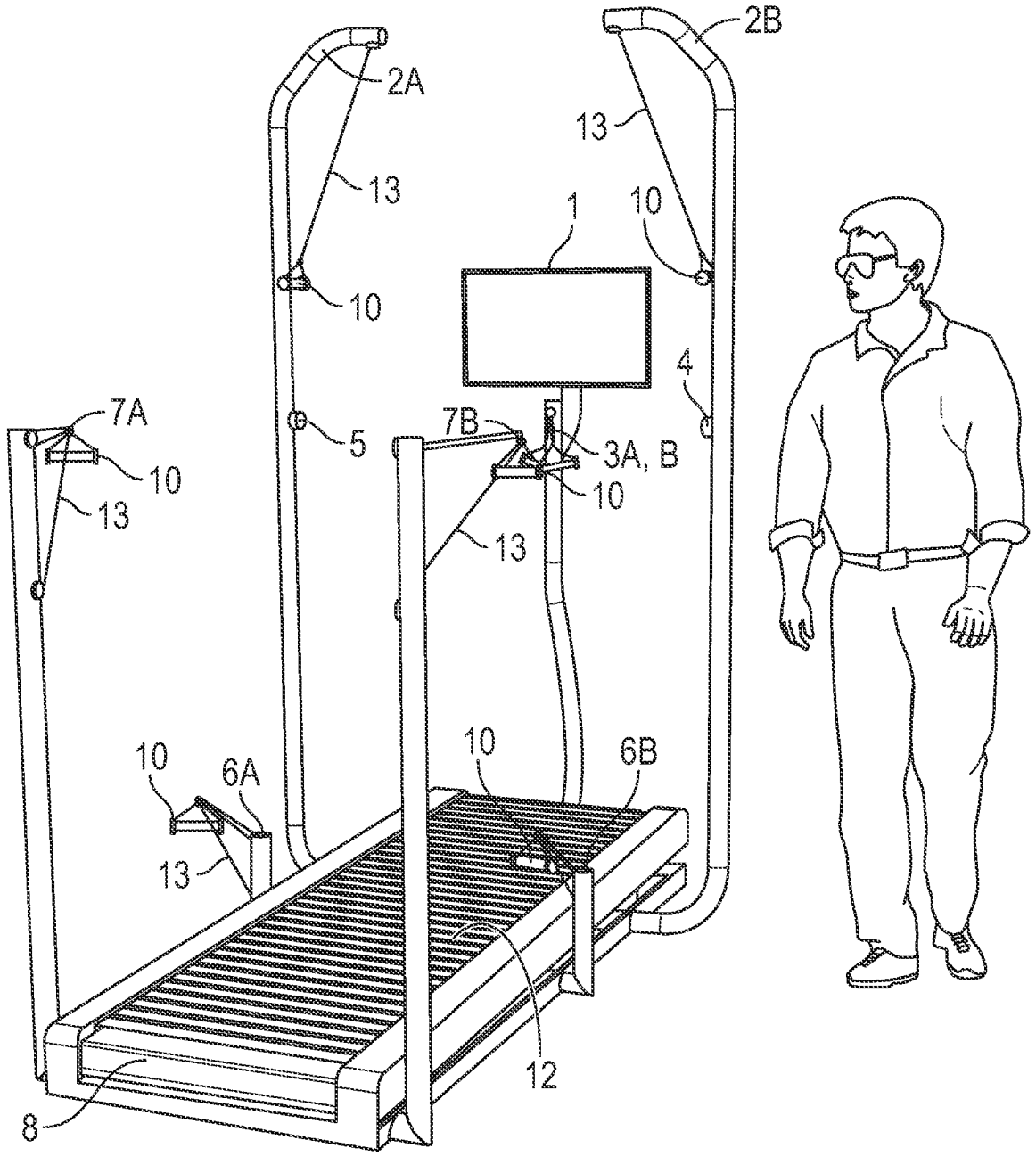
FIG. 3 is a rear-side perspective view of the fitness apparatus of FIG. 1.
Figure 4:
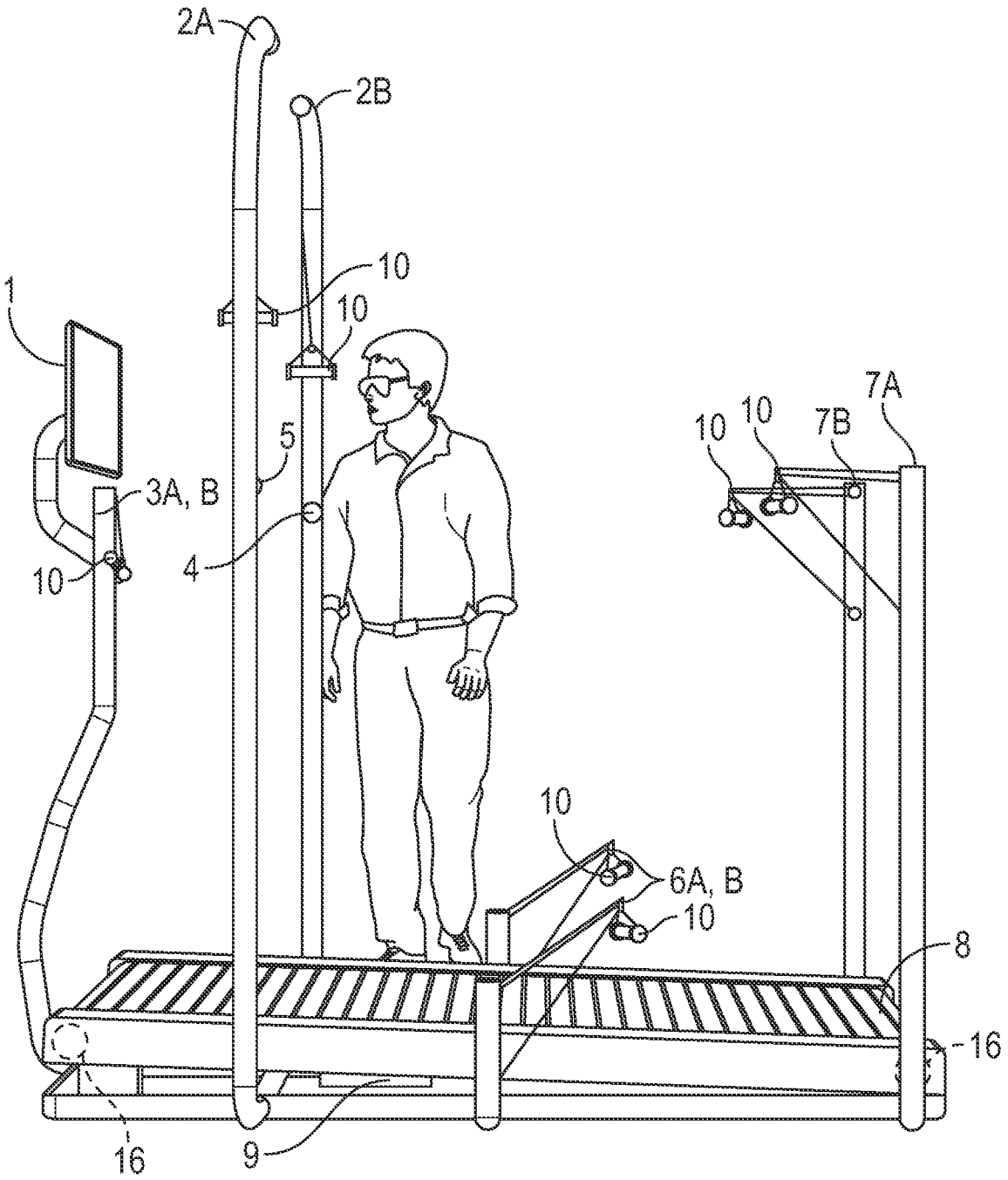
FIG. 4 is a side perspective view of the fitness apparatus of FIG. 1.
Figure 5:
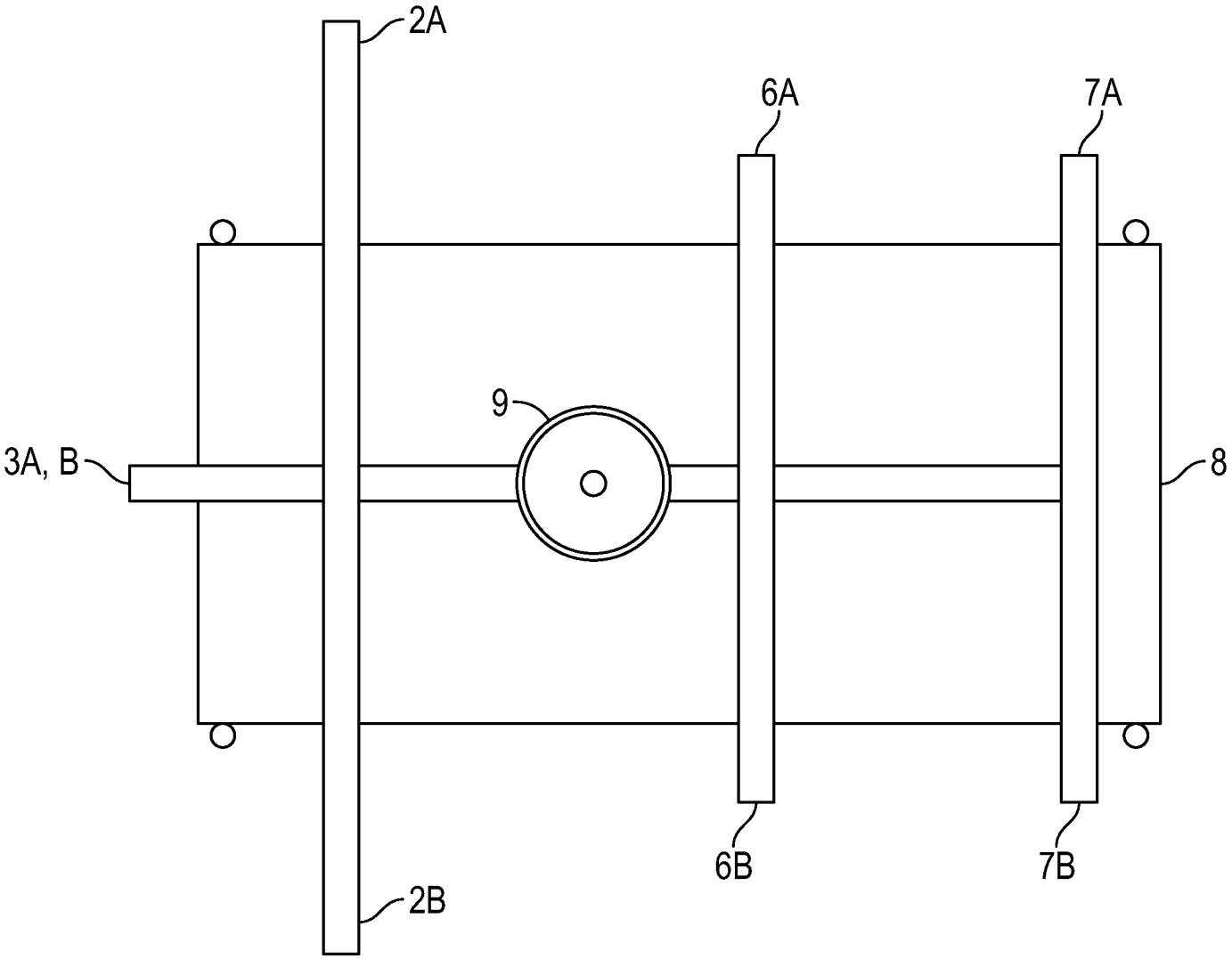
FIG. 5 is a bottom plan view of a fitness apparatus, according to another embodiment of the invention.
Figure 6:
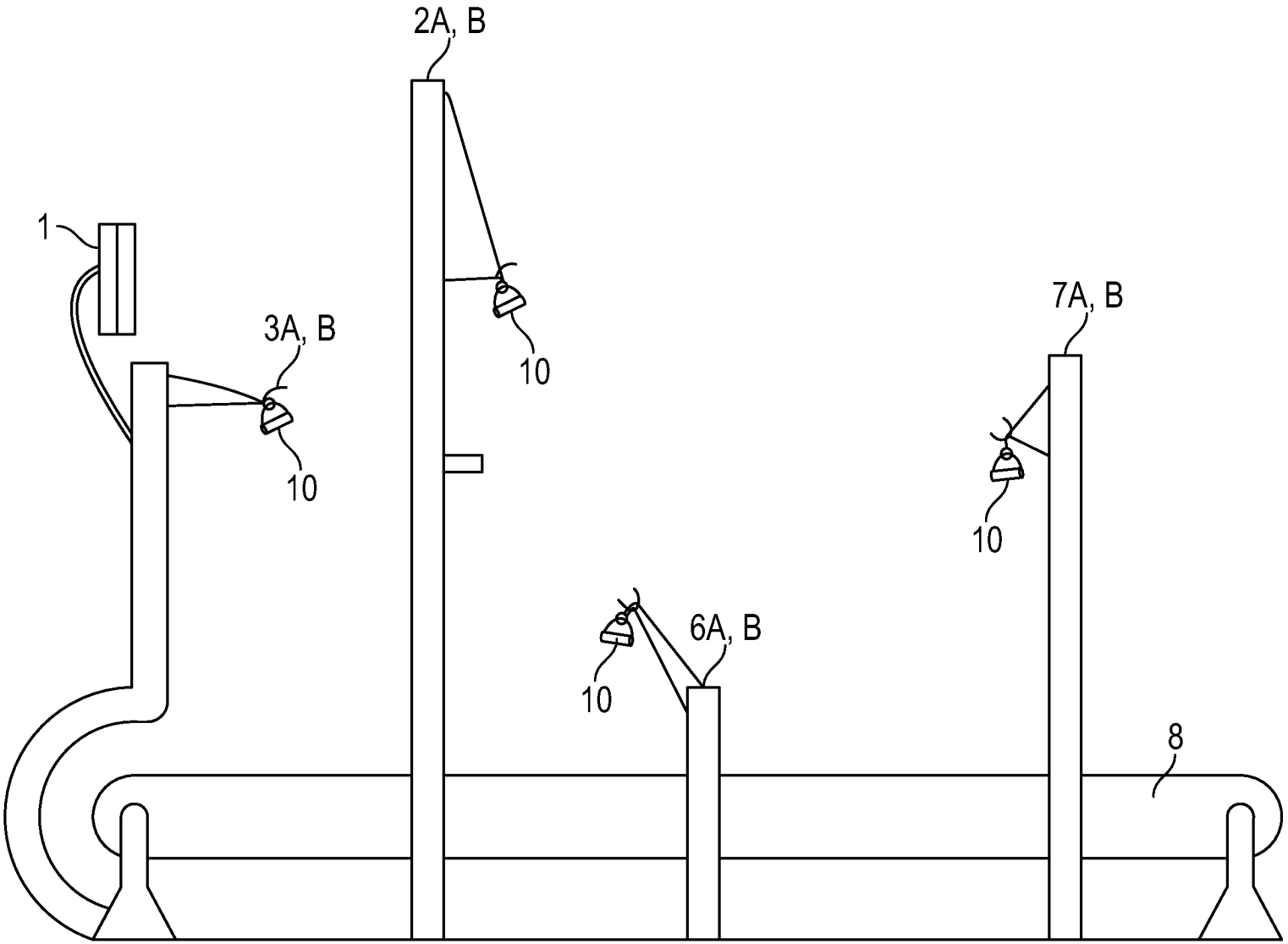
FIG. 6 is a side elevational view of the fitness apparatus of FIG. 5.
Figure 7:
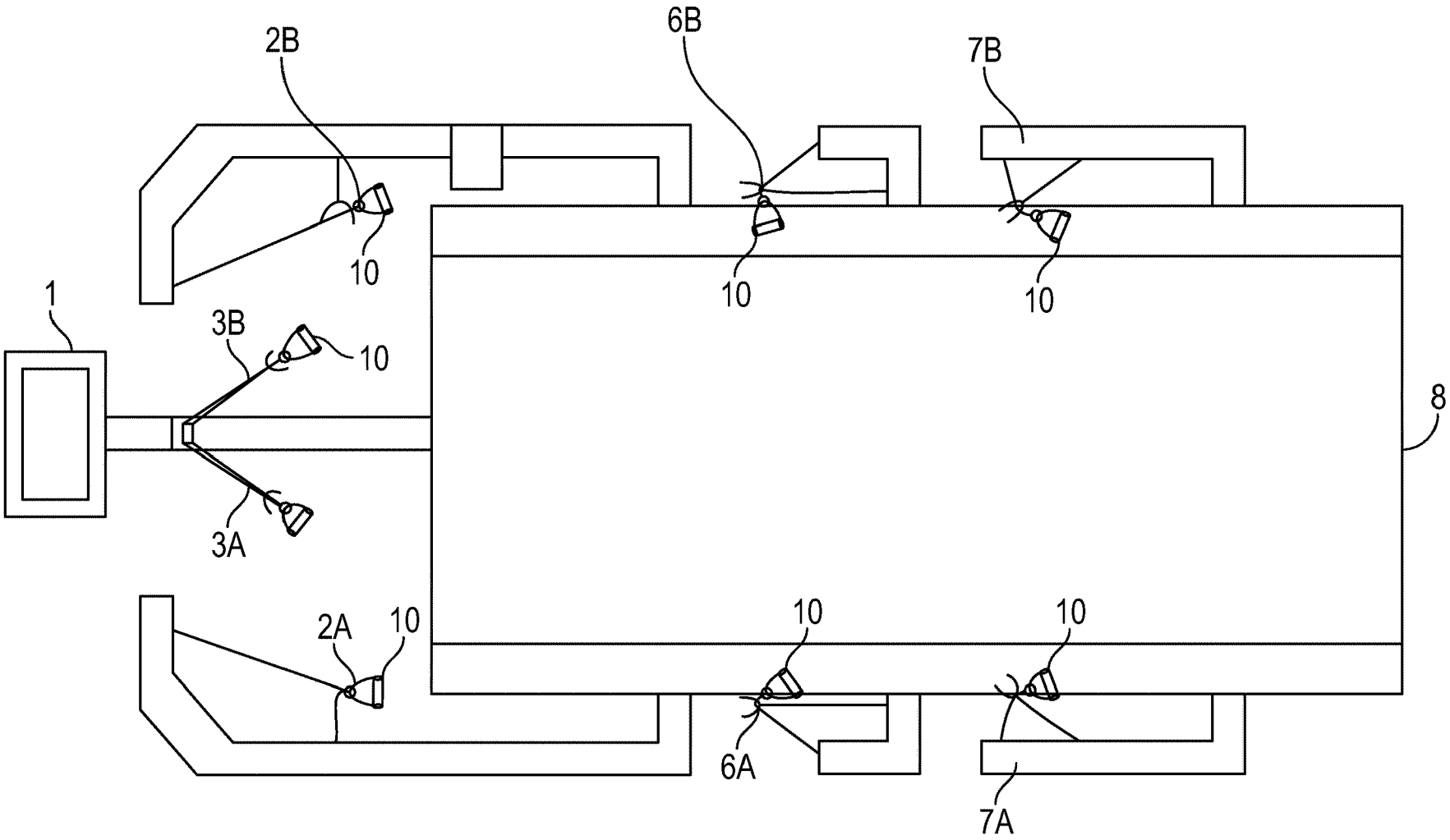
FIG. 7 is a top plan view of the fitness apparatus of FIG. 5.
Figure 8:
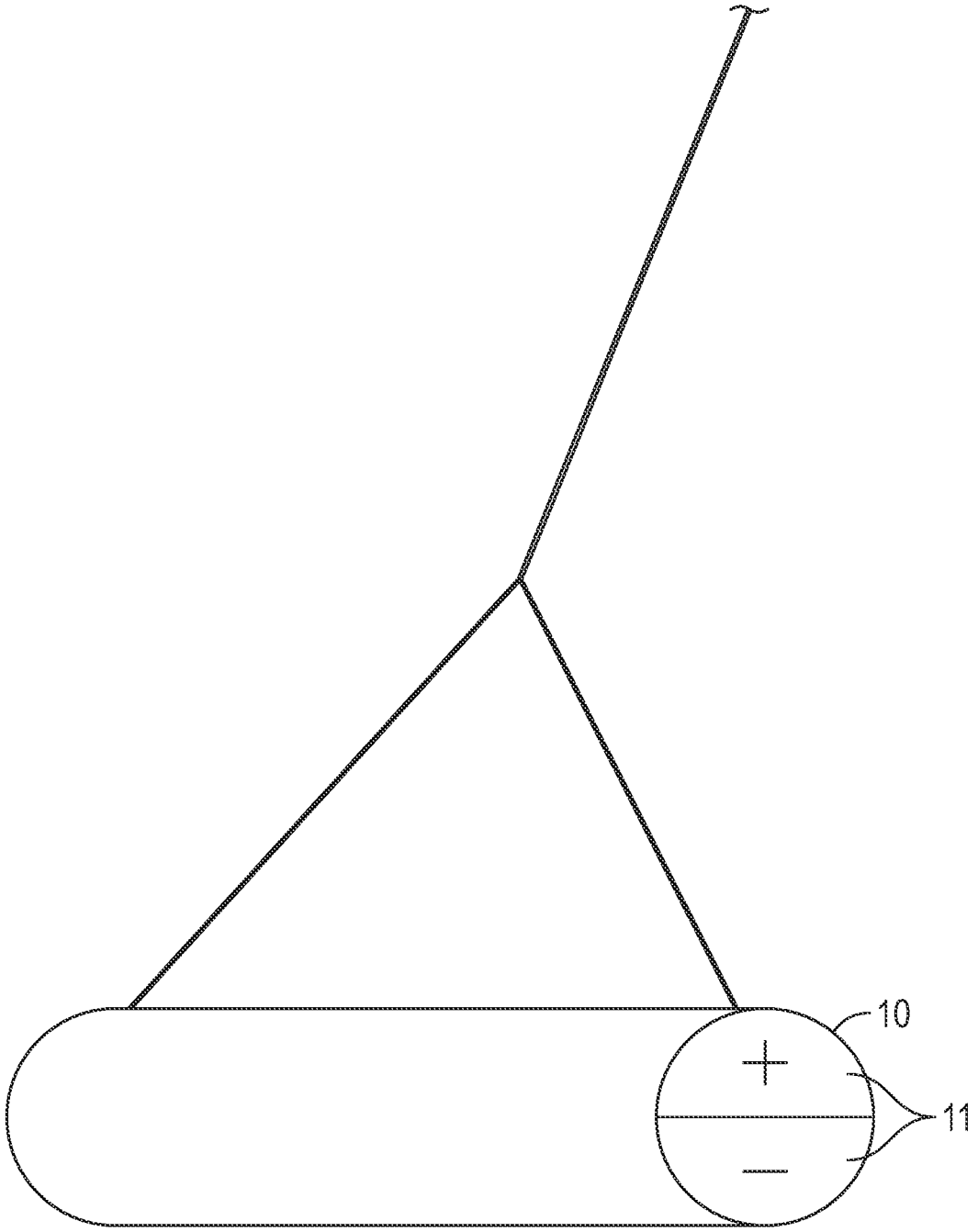
FIG. 8 is a detail perspective view of one of the hand controls of the fitness apparatus of FIGS. 1 and 5.
Figure 9:
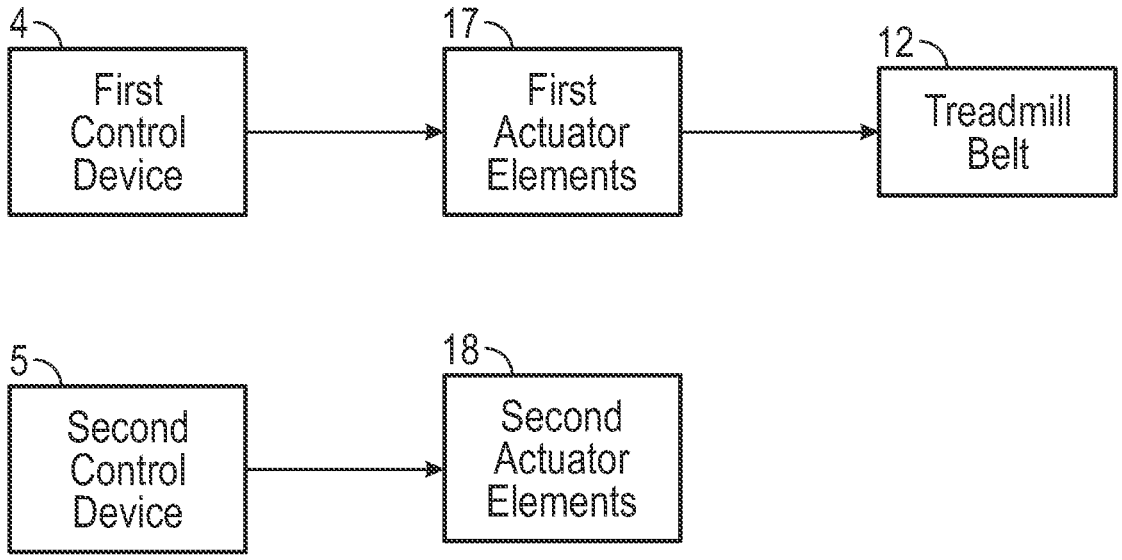
FIG. 9 is a block diagram illustrating functional components of the fitness apparatus of FIG. 1.

In the illustrative embodiment, with reference to FIGS. 1 and 3, it can be seen that the one or more displaceable treadmill elements of the treadmill 8 comprise a treadmill belt 12 (e.g., a notched or slotted treadmill belt) configured to rotate about a pair of spaced-apart rollers 16 (see FIG. 4). Also, in the illustrative embodiment, the treadmill 8 further comprises one or more first actuator elements 17 that are capable of adjusting a speed of the treadmill belt 12, and one or more second actuator elements 18 that are capable of adjusting the inclination and declination of the treadmill 8 (refer to FIG. 9). In addition, as best shown in FIGS. 3 and 9 of the illustrative embodiment, the treadmill further comprises a first control device 4 (e.g., a speed control wheel) operatively coupled to the one or more first actuator elements 17. The first control device 4 (e.g., the speed control wheel) enables the user to selectively adjust the speed of the treadmill belt 12. Also, as illustrated in FIGS. 3 and 9, the treadmill 8 of the illustrative embodiment further comprises a second control device 5 (e.g., an incline/decline control wheel) operatively coupled to the one or more second actuator elements 18. The second control device 5 (e.g., the incline/decline control wheel) enables the user to selectively adjust the inclination and declination of the treadmill 8.

Figure 2:
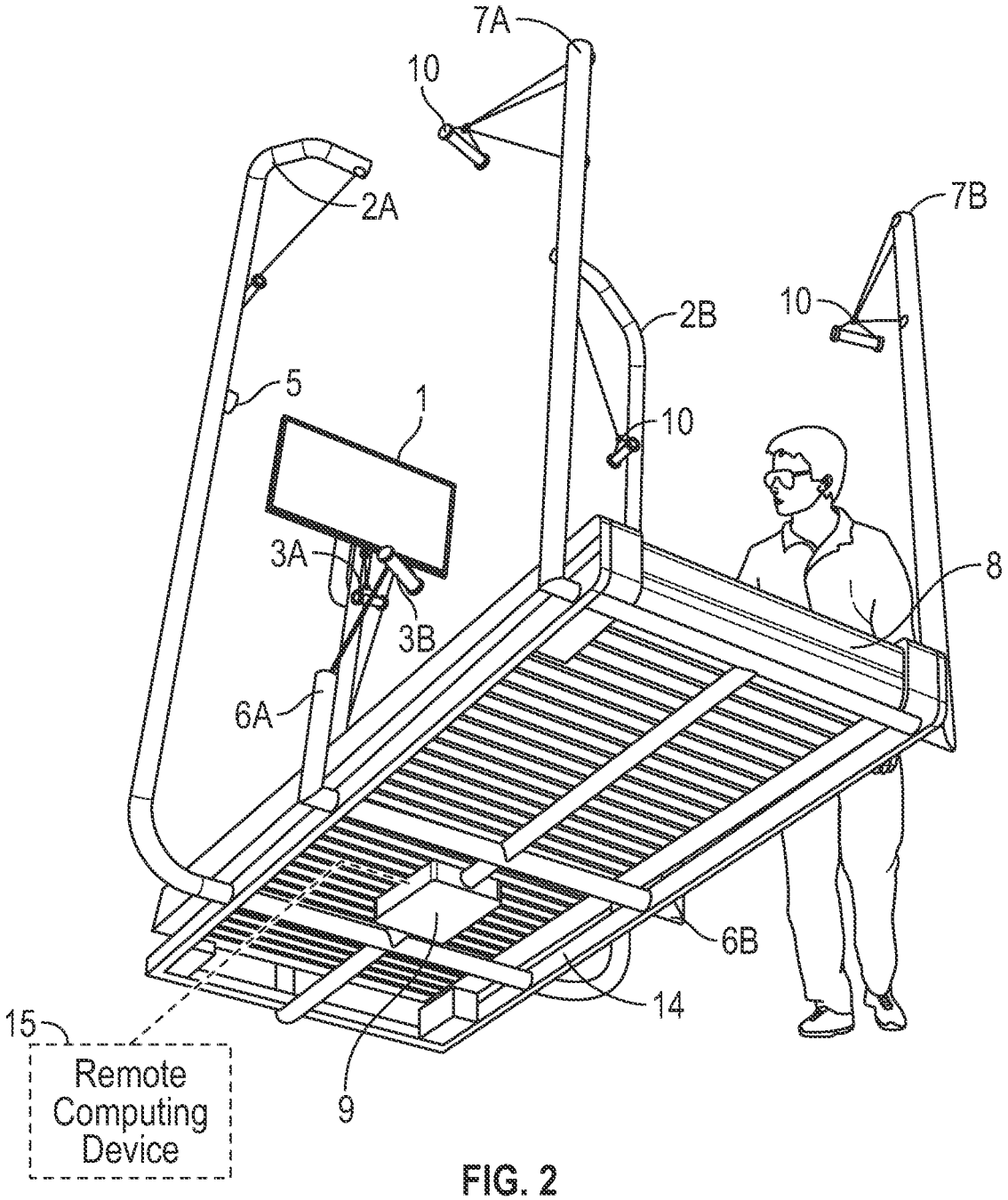
FIG. 2 is a bottom-side perspective view of the fitness apparatus of FIG. 1.

With combined reference to FIGS. 1-4, in the illustrative embodiment, the plurality of resistance assemblies 2A, 2B, 3A, 3B, 6A, 6B, 7A, 7B are disposed around an outer periphery of the treadmill 8. More specifically, referring to these figures of the illustrative embodiment, a front set of resistance assemblies 3A, 3B are disposed proximate to the front of the treadmill 8. A first set of upper resistance assemblies 2A, 2B are disposed on opposed sides of the treadmill 8, and are located above the resting hand positions of the user when the user is standing so that the user extends upwardly with his or her arms when using these resistance assemblies 2A, 2B. A second set of lower resistance assemblies 6A, 6B are disposed on opposed sides of the treadmill 8, and are located below the resting hand positions of the user when the user is standing so that the user extends downwardly with his or her arms when using these resistance assemblies 6A, 6B. A third set of rear resistance assemblies 7A, 7B are disposed proximate to the rear of the treadmill 8. In the illustrative embodiment, the resistance assemblies 2A, 3A, 6A, 7A are configured to be grasped by the left hand of the user, while the resistance assemblies 2B, 3B, 6B, 7B are configured to be grasped by the right hand of the user. As best shown in FIG. 2, in the illustrative embodiment, the plurality of resistance assemblies 2A, 2B, 3A, 3B, 6A, 6B, 7A, 7B are coupled to the treadmill 8 by a base assembly 14 disposed underneath the treadmill 8.

Referring again to the illustrative embodiment of FIGS. 1-4, each of the eight (8) resistance assemblies 2A, 2B, 3A, 3B, 6A, 6B, 7A, 7B comprises a resistance cable 13 attached to a handle 10 at one end of the resistance cable 13. In the illustrative embodiment, the handle 10 of each resistance assembly 2A, 2B, 3A, 3B, 6A, 6B, 7A, 7B comprises a hand control device 11 for enabling the user to selectively adjust the resistance load of the resistance assembly 2A, 2B, 3A, 3B, 6A, 6B, 7A, 7B (see e.g., FIG. 8). For example, referring to FIG. 8, when a user presses the "+" button of the hand control device 11 on the handle 10, the resistance load of the resistance assembly 2A, 2B, 3A, 3B, 6A, 6B, 7A, 7B increases. Conversely, when a user presses the "–" button of the hand control device 11 on the handle 10 (see FIG. 8), the resistance load of the resistance assembly 2A, 2B, 3A, 3B, 6A, 6B, 7A, 7B decreases. Advantageously, the hand control device 11 on the handle 10 gives the user the ability to change exercises and loads on the fly from one exercise to another or allow muscle time under tension (TUT) to increase until muscle exhaustion is achieved. In the illustrative embodiment, the hand control device 11 on the handle 10 has the capability of turning the resistance load on, off, up or down quasi-instantaneously. This functionality advantageously allows a user to focus on muscle time under tension (TUT) and increase muscle exhaustion. For example, a user can start a chest press at 75 lbs. When that load becomes too much, the user can decrease the load to allow for more repetitions. Once the desired repetitions are completed, the user can adjust the load and begin a chest fly. The whole time the chest muscles have never been taken out of contraction.

Figure 10:
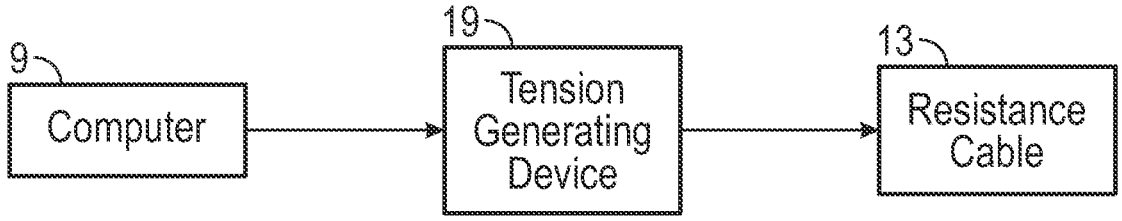
FIG. 10 is a block diagram illustrating functional components of the fitness apparatus of FIG. 1.

In the illustrative embodiment, each resistance assembly 2A, 2B, 3A, 3B, 6A, 6B, 7A, 7B further comprises a tension generating device 19 coupled to the resistance cable 13 (refer to FIG. 10). The tension generating device 19 of each resistance assembly 2A, 2B, 3A, 3B, 6A, 6B, 7A, 7B may comprise at least one of an electrical resistance device, one or more pneumatic devices, one or more hydraulic devices, one or more springs, one or more weights, one or more flexing nylon rods, one or more elastics (e.g., elastics comprising rubber bands/resistance bands), and one or more friction-based devices. One or more of the resistance assemblies 2A, 2B, 3A, 3B, 6A, 6B, 7A, 7B may further comprise a variable resistance cable and pulley system, a flywheel, an electromagnetic resistance motor, and/or a torque sensor. In the illustrative embodiment, the tension generating device 19 of the resistance assemblies 2A, 2B, 3A, 3B, 6A, 6B, 7A, 7B comprises an electrical resistance device operatively coupled to a data processing device (e.g., a variable resistance control motor and computer 9—see FIGS. 2 and 4). For example, in the illustrative embodiment, the variable resistance control motor may comprise a three-phase brushless direct-current (BLDC) motor to generate tension/resistance. In the illustrative embodiment, referring to FIG. 10, the data processing device (e.g., the computer of the variable resistance control motor and computer 9) is configured to control the resistance load of the resistance assemblies 2A, 2B, 3A, 3B, 6A, 6B, 7A, 7B by regulating an amount of tension generated by the tension generating device 19 (e.g., the variable resistance control motor of the variable resistance control motor and computer 9). In addition, in the illustrative embodiment, the computer of the variable resistance control motor and computer 9 may also be operatively coupled to a remote computing device 15 so as to enable a sharing of user performance data with an individual located remotely (e.g., by means of an internet connection to the remote computing device 15—see FIG. 2). In the illustrative embodiment, the fitness apparatus is a computer-configured exercise system with means for sharing exercise system related data and/or user performance data with a secondary user, such as a medical professional, a physical therapist, a trainer, a computer-generated competitor, and/or a human competitor. For example, the exercise system is used with a remote trainer to enhance exercise performance, with a remote medical professional for rehabilitation, and/or with a competitor in a competition.

In the illustrative embodiment, the fitness apparatus, which uses electricity to generate tension/resistance, may also be versatile by way of electronic and/or digital control. Electronic control enables the use of software to control and direct tension. By contrast, conventional exercise devices require tension to be changed physically/manually. For example, in the case of a weight stack, a pin must be moved by a user from one metal plate to another.

With reference again to FIGS. 1-4, in the illustrative embodiment, the fitness apparatus further comprises a visual display device 1 or display screen 1 coupled to the treadmill 8. The visual display device 1 is configured to display screen images to the user that provide the user a visual guide on proper form and exercise progression together with workout performance parameters (e.g., heart rate, calories burned, work done, etc.). In the illustrative embodiment, the fitness apparatus may also include a wearable tracker that monitors heart rate, heart rate variability, calories burned, fuel percentage, work done (in joules), recovery, and sleep.

A second illustrative embodiment of a fitness apparatus is shown in FIGS. 5-8. Referring to these figures, it can be seen that, in many respects, the second illustrative embodiment is similar to that of the first illustrative embodiment. Moreover, many elements are common to both such embodiments. For the sake of brevity, the elements that the second illustrative embodiment of the fitness apparatus has in common with the first illustrative embodiment will not be discussed because these components have already been explained in detail above. Furthermore, in the interest of clarity, these elements are denoted using the same reference characters that were used in the first illustrative embodiment.

As shown in FIGS. 5-8, the second illustrative embodiment of the fitness apparatus has generally the same core components as the first illustrative embodiment of FIGS. 1-4, expect that the arrangement of some components is slightly different (e.g., the configuration of the resistance assemblies 2A, 2B, 3A, 3B, 6A, 6B, 7A, 7B are slightly different in the second illustrative embodiment).

Advantageously, the aforedescribed fitness apparatus combines elements of a treadmill with elements of a functional trainer. The uniqueness of this apparatus allows for maximal stimulation of the proprioceptive system. By changing one's walking speed, incline, decline, resistance exercise, plane in which exercise is performed, joint angles and hand grip of exercise performed allow for unlimited combinations that stimulate proprioception, which in turn, increase neuromuscular efficiency, motor unit recruitment, and neural activation and rate coding. All are fundamental requirements for improving fitness levels.

The fitness apparatus described above enhances neuromuscular efficiency (NME) in a way that would otherwise take multiple pieces of training equipment. It manipulates multiple acute training variables simultaneously (i.e., repetitions, sets, training intensity, repetition tempo, training volume, rest interval, training frequency, training duration, and exercise selection), and it introduces new acute training variables (i.e., gait length, gait speed, degree of incline/decline, heart rate range, and time under tension) in a way that supports the SAID (specific adaptation to imposed demands) principal.

The fitness apparatus described above introduces a new form of fitness, namely STIM (Strength Training in Motion). The arrangement of the apparatus allows for strength training exercises to be performed in multi-planar movements (or movements in all directions) through the full muscle action spectrum (concentric acceleration, eccentric deceleration, and isometric stabilization) in motion. STIM increases training efficiency by allowing strength training exercises to be done in an aerobic state. The benefits of aerobic and anaerobic exercise are achieved in one workout on one machine.

The ability of the aforedescribed fitness apparatus to increase or decrease the training load in the middle of a set and the ability to switch from one exercise to the next grants the capability to increase muscle contraction times and gain the benefits without having to use heavy loads like in traditional training protocols. This unique configuration allows for safer and more efficient training by decreasing the loads that are required to stimulate muscle growth.

Now, the new Strength Training in Motion (STIM) method that may be practiced using the aforedescribed fitness apparatus will be explained in further detail. The fitness apparatus described above was built on a foundation of principles that progressively and systematically allow any individual to achieve optimal levels of physiologic, physical, and performance adaptations. The fitness apparatus can manipulate all the acute training variables at any given time, which enables the ability to change the stress placed on the body and keep the body from plateauing on any one stress type. The science behind the fitness apparatus focuses on heart rate (HR) manipulation through resistance training. It combines one or more acute training variables to mimic high-intensity interval training (HIIT) workouts without the extreme intensity that normal HIIT workouts require. The workout performed using the fitness apparatus is combining aerobic and anaerobic exercises forms together to increase workout efficiency.

When one begins a resistance movement in motion, his or her body is forced to be in a proper position. The body is forced to keep its stabilization muscles under contraction. The stabilization muscles are under contraction through a range of motion which is determined by individual's current gait and current resistance movement. Individuals gait and degree of incline or decline will determine which stabilization muscles are being stimulated and to what degree. Stabilization muscles are subject to eccentric, concentric and isometric contractions during the entire workout at variable intensities dependent on the program design.

Walking on the fitness apparatus described above will give the individual an increased base heart rate (HR). When a resistance movement is incorporated, the muscles performing the resistance movement call for more blood which in turn increases the heart rate. When resistance movement is over, the individual is forced to recover in an active state (stress from base heart rate from walking speed) which will help the individual increase its ability to use $O_2$ efficiently. Once the heart rate recovers to elevated base line, the individual can then begin the next set in the program. The individual's ability to recover the heart rate to base will determine the time lapse between sets. A direct correlation between recovery time and total exercise volume is established. When recovery time decreases and the total exercise volume increases, the individual's work capacity increases. When the individual's work capacity increases, their ability to do more work for a longer period of time increases. This allows for a higher amount of fuel to be burned during the workout.

The fitness apparatus uses variable resistance to allow the user to focus on time under tension (TUT) and muscle exhaustion to simulate type I and type II muscle fibers at lower intensities. Stabilization muscles predominantly have a higher type I ratio. These fibers are in a continuous state of low intensity stress through a certain range of motion depending on gait and incline/decline degree. When one adds a resistance exercise on top of the walking, he or she increases the stimuli intensity from low to possible high depending on the program design. So, our type I fibers are under a variable state of stress throughout the workout.

The resistance aspect allows the individual now to put a stimulus on type II muscle fibers. When one begins an exercise with resistance, the stress on the stability muscles increase as well as the stress on the prime movers of the exercise. As the repetitions increase and the individual moves closer to failure, the greater the stress becomes on type II fibers. With the ability to decrease the resistance mid-exercise, the capability to maximize the stress on type II fibers is enabled while keeping the overall resistance on the lower end of the spectrum. The incline/decline capabilities of the treadmill 8 coupled with gait length variability, exercise selection and resistance load variability put the body through the entire muscle action spectrum (eccentric, isometric, and concentric) in multi-planar movements which increase NME (neuromuscular efficiency).

The Volume Wave Principle is based on a few key acute training variables which are used in a progression to manipulate the work out volume (total volume=exercise×sets×repetitions).

Exercise selection is the process of choosing exercises for program design that allow for the optimal achievement of the desired adaptation. It has a tremendous impact on the outcome of the training program. The human movement system is a highly adaptable system that readily adjusts to the imposed demands of training (principle of specificity). First, exercises that are multi-jointed and focus on core stabilization should be applied. Once the adaptations have occurred, then single joint exercises can be added sequentially, which will increase training volume. In the context of the exercise described herein, these terms as defined as follows:

1. Training frequency refers to the number of training sessions that are performed during a given period (usually 1 week). Beginners may start off with a 2-day split and over time as they progress through the physiological changes, they add another day to their split. By progressing through a training frequency progression from a 2-day split to possibly a 5-day split, the volume is drastically manipulated.
2. A repetition is one complete movement of a particular exercise. Most repetitions will involve the three muscle actions: concentric, isometric, and eccentric (not necessarily in that order). By increasing the repetitions for each set, the overall volume done during the workout will increase.
3. A set is a group of consecutive repetitions. By adding another set to each exercise, the overall volume will increase.

The first half of the volume wave is mostly manipulated by frequency and exercise selection. Helping the body get use to the new stimulus and focusing on building stabilization muscles and increasing $VO_2$ max and RMR (resting metabolic rate). In one example, a subject starts a 2-day split which consists of 3 sets of 20 repetitions of 4 exercises (i.e., TV=240 per workout and TV=480 for the week). Then, the subject adds a day to their split (i.e., TV for the week goes from 480 to 720), or the subject adds one exercise to the current split (i.e., TV per workout goes from 240 to 300, and TV for the week goes from 480 to 600).

By adding the correct exercises and increasing frequency, the body will adapt and become more efficient. This forces the body to be able to handle more work. Once a plateau is reached with frequency and exercise selection, then sets and repetitions take over on the volume principle as the main manipulator of the workouts.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A fitness apparatus, comprising:

a treadmill, the treadmill having one or more displaceable treadmill elements that are configured to receive a user thereon;

a plurality of resistance assemblies coupled to the treadmill, each of the plurality of resistance assemblies configured to create a resistance load for the user so that the user is able to perform strength exercises while simultaneously performing cardiovascular exercises on the treadmill, the plurality of resistance assemblies disposed around an outer periphery of the treadmill, one or more first ones of the plurality of resistance assemblies being positioned such that the user extends upwardly with his or her arms when using the one or more first ones of the plurality of resistance assemblies, the one or more first ones of the plurality of resistance assemblies including a first upright post member having a first height, one or more second ones of the plurality of resistance assemblies being positioned such that the user extends downwardly with his or her arms when using the one or more second ones of the plurality of resistance assemblies, the one or more second ones of the plurality of resistance assemblies including a second upright post member having a second height, and one or more third ones of the plurality of resistance assemblies being positioned closer to a rear of the treadmill than the one or more first and second ones of the plurality of resistance assemblies, the one or more third ones of the plurality of resistance assemblies including a third upright post member having a third height, the first and third heights of the respective first and third upright post members being greater than the second height of the second upright post member, and the first height of the first upright post member being greater than the third height of the third upright post member; and a variable resistance control motor and computer assembly operatively coupled to the plurality of resistance assemblies, the variable resistance control motor and computer assembly configured to control the resistance load of the plurality of resistance assemblies.

2. The fitness apparatus according to claim 1, wherein the one or more displaceable treadmill elements comprise a treadmill belt configured to rotate about a pair of spaced-apart rollers.

3. The fitness apparatus according to claim 2, wherein the treadmill further comprises one or more first actuator elements that are capable of adjusting a speed of the treadmill belt.

4. The fitness apparatus according to claim 3, wherein the treadmill further comprises a first control device operatively coupled to the one or more first actuator elements, the first control device enabling the user to selectively adjust the speed of the treadmill belt.

5. The fitness apparatus according to claim 1, wherein the treadmill further comprises one or more second actuator elements that are capable of adjusting the inclination and declination of the treadmill.

6. The fitness apparatus according to claim 5, wherein the treadmill further comprises a second control device operatively coupled to the one or more second actuator elements, the second control device enabling the user to selectively adjust the inclination and declination of the treadmill.

7. The fitness apparatus according to claim 1, wherein at least one of the one or more first ones of the plurality of resistance assemblies is disposed proximate to a front of the treadmill, at least another one of the one or more second ones of the plurality of resistance assemblies is disposed on a side of the treadmill, and at least yet another one of the one or more third ones of the plurality of resistance assemblies is disposed proximate to the rear of the treadmill.

8. The fitness apparatus according to claim 1, wherein the plurality of resistance assemblies are coupled to the treadmill by a base assembly disposed underneath the treadmill.

9. The fitness apparatus according to claim 1, wherein at least one of the plurality of resistance assemblies comprises a resistance cable attached to a handle at one end of the resistance cable.

10. The fitness apparatus according to claim 9, wherein the handle of the at least one of the plurality of resistance assemblies comprises a hand control device for enabling the user to selectively adjust the resistance load of the at least one of the plurality of resistance assemblies.

11. The fitness apparatus according to claim 9, wherein the at least one of the plurality of resistance assemblies comprises a tension generating device coupled to the resistance cable.

12. The fitness apparatus according to claim 11, wherein the tension generating device of the at least one of the plurality of resistance assemblies comprises at least one of an electrical resistance device, one or more pneumatic devices, one or more hydraulic devices, one or more springs, one or more weights, one or more flexing nylon rods, one or more elastics, or one or more friction-based devices.

13. The fitness apparatus according to claim 11, wherein the tension generating device of the at least one of the plurality of resistance assemblies comprises at least one electrical resistance device operatively coupled to the variable resistance control motor and computer assembly, the variable resistance control motor and computer assembly configured to control the resistance load of the at least one of the plurality of resistance assemblies by regulating an amount of tension generated by the tension generating device.

14. The fitness apparatus according to claim 1, further comprising a visual display device coupled to the treadmill, the visual display device configured to display screen images to the user that provide the user a visual guide on proper form and exercise progression together with workout performance parameters.

15. The fitness apparatus according to claim 1, wherein the variable resistance control motor and computer assembly is operatively coupled to a remote computing device so as to enable a sharing of user performance data with an individual located remotely.

16. The fitness apparatus according to claim 1, wherein the variable resistance control motor and computer assembly is disposed underneath the treadmill.

17. A fitness apparatus, comprising:

a treadmill, the treadmill having one or more displaceable treadmill elements that are configured to receive a user thereon; and a plurality of resistance assemblies coupled to the treadmill, each of the plurality of resistance assemblies configured to create a resistance load for the user so that the user is able to perform strength exercises while simultaneously performing cardiovascular exercises on the treadmill, the plurality of resistance assemblies disposed around an outer periphery of the treadmill, one or more first ones of the plurality of resistance assemblies being positioned such that the user extends upwardly with his or her arms when using the one or more first ones of the plurality of resistance assemblies, the one or more first ones of the plurality of resistance assemblies including a first upright post member having a first height, one or more second ones of the plurality of resistance assemblies being positioned such that the user extends downwardly with his or her arms when using the one or more second ones of the plurality of resistance assemblies, the one or more second ones of the plurality of resistance assemblies including a second upright post member having a second height, and one or more third ones of the plurality of resistance assemblies being positioned closer to a rear of the treadmill than the one or more first and second ones of the plurality of resistance assemblies, the one or more third ones of the plurality of resistance assemblies including a third upright post member having a third height, the first and third heights of the respective first and third upright post members being greater than the second height of the second upright post member, and the first height of the first upright post member being greater than the third height of the third upright post member.

* * * * *